US008784218B2

(12) United States Patent
Harris

(10) Patent No.: US 8,784,218 B2
(45) Date of Patent: Jul. 22, 2014

(54) SELF DEFENSE HAND BAND

(75) Inventor: Christopher L. Harris, Frisco, TX (US)

(73) Assignee: Armaband, LLC, Corinth, TX (US)

( * ) Notice: Subject to any disclaimer, the term of this patent is extended or adjusted under 35 U.S.C. 154(b) by 0 days.

(21) Appl. No.: 13/480,342

(22) Filed: May 24, 2012

(65) Prior Publication Data

US 2013/0123024 A1 May 16, 2013

Related U.S. Application Data

(60) Provisional application No. 61/559,753, filed on Nov. 15, 2011.

(51) Int. Cl.
*F41B 15/02* (2006.01)
*A44C 5/00* (2006.01)

(52) U.S. Cl.
USPC ..... 463/47.2; 63/1.11; 2/170

(58) Field of Classification Search
USPC ..... 463/47.2; 2/16, 162, 170, 917, 159, 2/160; 482/44, 45; 602/21
See application file for complete search history.

(56) References Cited

U.S. PATENT DOCUMENTS

| | | | | |
|---|---|---|---|---|
| 1,583,754 | A | 5/1926 | Rogers | |
| 3,373,445 | A * | 3/1968 | O'Neill | 2/170 |
| 4,632,105 | A | 12/1986 | Barlow | |
| 4,681,462 | A * | 7/1987 | Lloyd | 368/69 |
| 5,491,984 | A * | 2/1996 | Loch | 63/3 |
| 5,538,164 | A | 7/1996 | Rivas | |
| 5,564,082 | A * | 10/1996 | Blonder et al. | 455/575.6 |
| D377,862 | S * | 2/1997 | Moore | D3/228 |
| 6,094,747 | A * | 8/2000 | Malick | 2/159 |
| 6,687,916 | B2 * | 2/2004 | Thompson | 2/170 |
| 6,991,364 | B2 * | 1/2006 | Yang | 368/281 |
| 7,794,139 | B2 * | 9/2010 | Barbier | 368/282 |
| 8,140,143 | B2 * | 3/2012 | Picard et al. | 600/388 |
| 8,265,692 | B2 * | 9/2012 | Fish | 455/556.1 |
| 8,317,242 | B2 * | 11/2012 | Yu | 294/25 |
| 2003/0026170 | A1 * | 2/2003 | Yang | 368/10 |
| 2003/0172436 | A1 | 9/2003 | Thompson | |
| 2006/0144083 | A1 * | 7/2006 | Layton | 63/3.1 |
| 2008/0146981 | A1 | 6/2008 | Greenwald et al. | |
| 2010/0268056 | A1 * | 10/2010 | Picard et al. | 600/388 |

FOREIGN PATENT DOCUMENTS

| | | |
|---|---|---|
| JP | 2007218571 | 8/2007 |
| WO | WO2011030182 | 3/2011 |

OTHER PUBLICATIONS

International Search Report for PCT/US12/65037 filed Nov. 14, 2012; 2 pgs.
Written Opinion for PCT/US12/65037 filed Nov. 14, 2012; 3 pgs.

* cited by examiner

*Primary Examiner* — William Pierce
(74) *Attorney, Agent, or Firm* — Kirby B. Drake; Klemchuk Kubasta LLP

(57) ABSTRACT

A protective device to be worn around the wrist of the user may include a wristband to be positioned around the wrist of the user and a hand band to be positioned around the wrist of the user in a first state and to be positioned around the hand of the user and a second state. The wristband may include a nerve point tool to scratch an assailant. The hand band may include a nerve point tool to scratch an assailant.

5 Claims, 1 Drawing Sheet

SELF DEFENSE HAND BAND

PRIORITY

The present invention claims priority under 35 USC section 119 and based upon the provisional application which was filed on Nov. 15, 2011 with a Ser. No. 61/559,753.

FIELD OF THE INVENTION

The present invention relates to a protection device and more particularly to a protection device to help a person protect him or herself against a physical assault and to help escort a person.

BACKGROUND

Crimes against a person involving physical violence are one of the worst crimes in modern society. These types of crimes may strike suddenly without a lot of warning and consequently may limit the ability to call for help or to flee the attacker. As a consequence, it may be necessary to have a protection device which is readily available. In some jurisdictions, it may be against the law to carry a gun. Other types of protective devices such as knives may be difficult to keep readily available. There is a need for a protective device that can be easily accessed.

SUMMARY

A protective device to be worn around the wrist of the user may include a wristband to be positioned around the wrist of the user and a hand band to be positioned around the wrist of the user in a first state and to be positioned around the hand of the user and a second state.

The wristband may include a nerve point tool to scratch an assailant.

The hand band may include a nerve point tool to scratch an assailant.

The wristband may be connected to the hand band with a fastener.

The wristband may include an interior band portion having a nerve point tool.

The hand band may include a palm band portion having a nerve point tool.

The hand band may include a back hand band portion having a nerve point tool.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 1:
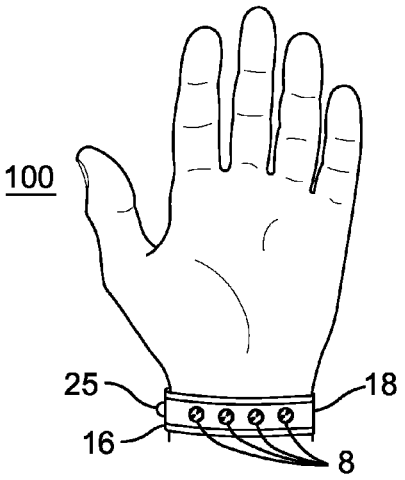
FIG. 1 illustrates a front perspective view of the protection device of the present invention.

The protection device 100 may include a double banded wrist band which may include a wristband 16 and a hand band 18 which may be positioned over the wristband 16 in a first state which may be an unarmed state. The wristband 16 and the hand band 18 may be formed from flexible and expandable material so that the wristband 16 and the hand band 18 may be placed over the hand and onto the wrist of the user. Furthermore, the hand band 18 may be expanded and extend over the thumb of the user to extend over the palm of the hand of the user. The protection device 100 may be extended to a second state which may be unarmed state. The protection device 100 can be armed by pulling the hand band 18 over the thumb and positioning the hand band 18 naturally between the thumb and index finger while the wrist band 16 remains around the wrist of the user. The hand band 18 that is now resting in the palm of the hand may include a nerve point tool 8 to be used to scratch or to activate/stimulate a nerve point of an opponent or assailant and may be formed from metal, a hard plastic or other appropriate material which may include protruding points and edges, which can be used to defend one's self or to escort a person.

Description of Problem(s) Solved by Invention: The protection device 100 provides a significant mechanical advantage to the user when using their hands to defend themselves against an attacker by pressing, rubbing, or striking any exposed part of the attacker's body with the protection device 100. As a result, one can better defend themselves.

How the Invention is an Improvement over Existing Technology: A significant disadvantage of most self-defense products is their lack of immediate availability when needed most. The protection device 100 may be continuously safely secured to either one wrist or both wrists, making the protection device 100 available at all times instead of on a keychain, in a purse, or in a pocket. The availability of the protection device 100 provides significant advantage over the above-described devices. The protection device 100 may be used with either an open or closed hand, and the protection device 100 cannot be dropped, and the protection device 100 may not be taken from the user without great effort. This device is non-lethal in nature, simple to use, and suitable for almost everyone.

Groups of People and/or Businesses That Would Use the Invention: Men, women, teenagers, children, law enforcement, corrections, military and private security firms.

Benefits to Users of Invention: The protection device 100 assists the wearer in defending against physical attacks. The protection device 100 may be used with either an open or closed hand, cannot be dropped, and cannot be taken from the user without great effort. Worn around the wrist, the protection device 100 is readily available when needed.

FIG. 1 illustrates a front perspective view of the wrist and hand of the user and illustrates the hand band 18 which may be positioned over the wristband 16 and illustrates the nerve point tool 8 of the hand band 18. The hand band 18 and the wristband 16 are shown in the first state which may be an unarmed state. This allows the user for use of the hand while keeping the protection device 100 available for use.

FIG. 1 illustrates a upward extending tab 25 which may be positioned on the edge of the hand band 18 to assist the user in extending the hand band 18 over the hand of the user.

Figure 2:
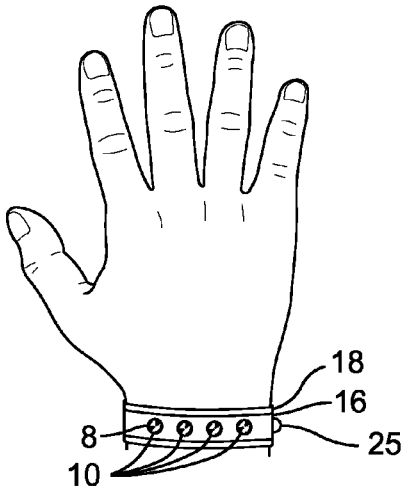
FIG. 2 illustrates a back perspective view of the protection device of the present invention.

FIG. 2 illustrates a back perspective view of the wristband 16 which may be positioned under the hand band 18 which may include the nerve point tool 8.

FIG. 2 illustrates the upward extending tab 25 which may be positioned on the edge of the hand band 18 to assist the user in extending the hand band 18 over the hand of the user.

Figure 3:
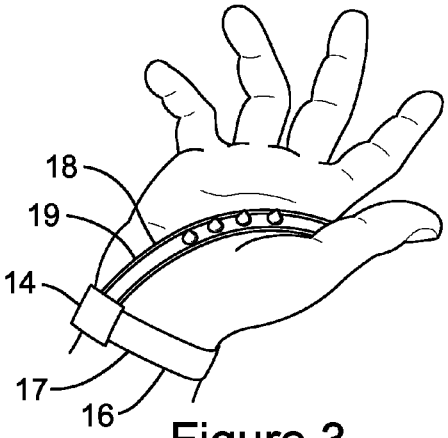
FIG. 3 illustrates a perspective view of a protection device of the present invention including the wristband and the hand band.

FIG. 3 illustrates an open hand of the user and illustrates a perspective view of the protection device 100 which may illustrate a palm band portion 19 of the hand band 18 which may include the nerve point tool 8 and which may illustrate an interior band portion 17 of the wristband 16. The palm band portion 19 may be connected to the interior band portion 17 by a fastener 14 which may be a button, a bolt, a sewn portion or other types of attachments and may extend across the palm of the user and between the thumb and first finger of the user. The palm band portion 19 may be connected to the back hand band portion 20 which may extend across the back of the hand of the user and may connect to the wristband 16 by the fastener 14.

The wristband 16 may include an interior band portion 17 which may extend across the interior wrist of the user and may include an exterior band portion 21 which may be connected to the interior band portion 17 which may extend across the exterior wrist of the user. The interior band portion 17 may include nerve point tool 8.

Figure 4:
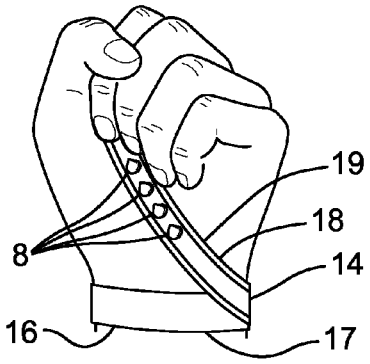
FIG. 4 illustrates a perspective view of a protection device of the present invention including the wristband and the hand band.

FIG. 4 illustrates a closed hand of the user and illustrates a perspective view of the protection device 100 which may illustrate a palm band portion 19 of the hand band 18 which may include the nerve point tool 8 and which may illustrate an interior band portion 17 of the wristband 16. The palm band portion 19 may be connected to the interior band portion 17 by a fastener 14 which may be a button, a bolt, a sewn portion or other types of attachments and may extend across the palm of the user and between the thumb and first finger of the user. The palm band portion 19 may be connected to the back hand band portion 20 which may extend across the back of the hand of the user and may connect to the wristband 16 by the fastener 14.

The wristband 16 may include an interior band portion 17 which may extend across the interior wrist of the user and may include an exterior band portion 21 which may be connected to the interior band portion 17 which may extend across the exterior wrist of the user. The interior band portion 17 may include nerve point tool 8.

Figure 5:
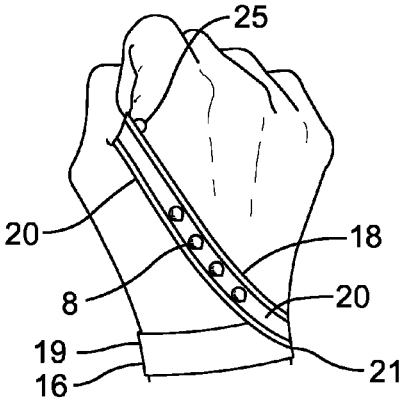
FIG. 5 illustrates a perspective view of the protection device of the present invention including the wristband and hand band.

FIG. 5 illustrates a back perspective view of a closed hand and illustrates a perspective view of the protection device 100 which may illustrate a palm band portion 19 of the hand band 18 which may include the nerve point tool 8 and which may include an interior band portion 17 of the wristband 16. The palm band portion 19 may be connected to the interior band portion 17 by a fastener 14 which may be a button, a bolt, a sewn portion or other types of attachments and may extend across the palm of the user and between the thumb and first finger of the user. The palm band portion 19 may be connected to the back hand band portion 20 which may extend across the back of the hand of the user and may connect to the wristband 16 by the fastener 14.

FIG. 5 illustrates the upward extending tab 25 which may be positioned on the edge of the hand band 18 to assist the user in extending the hand band 18 over the hand of the user.

The wristband 16 may include an interior band portion 17 which may extend across the interior wrist of the user and may include an exterior band portion 21 which may be connected to the interior band portion 17 which may extend across the exterior wrist of the user. The interior band portion 17 may include nerve point tool 8.

The protection device 100 may be in a second state and the band is armed.

Figure 6:
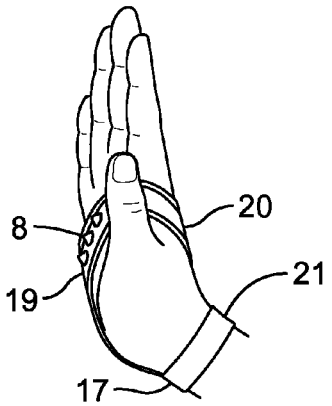
FIG. 6 illustrates a side perspective view of the protection device of the present invention including the wristband and hand band.

FIG. 6 illustrates a side perspective view of an open hand and FIG. 6 illustrates a perspective view of the protection device 100 which may include a palm band portion 19 of the hand band 18 which may include the nerve point tool 8 and which may illustrate an interior band portion 17 of the wristband 16. The palm band portion 19 may be connected to the interior band portion 17 by a fastener 14 which may be a button, a bolt, a sewn portion or other types of attachments and may extend across the palm of the user and between the thumb and first finger of the user. The palm band portion 19 may be connected to the back hand band portion 20 which may extend across the back of the hand of the user and may connect to the wristband 16 by the fastener 14.

The wristband 16 may include an interior band portion 17 which may extend across the interior wrist of the user and may include an exterior band portion 21 which may be connected to the interior band portion 17 which may extend across the exterior wrist of the user. The interior band portion 17 may include nerve point tool 8.

The band of the present invention is armed.

The protection device 100 may include only two or multiple durable elastic bands 16, 18 where one band lays over the other band or may lay adjacent to the other band. The two bands 16, 18 may be secured together by a plastic or metal fastener 14 at one point. The outer band may have a nerve point tool 8 which may include plastic parts on the side facing the back of the hand and the side facing the palm of the hand.

Relationship between the Parts of the Invention: The top (outer) band may be slightly larger in diameter than the bottom (inner) band and the larger band may lay over the smaller band. The two bands 16, 18 may be secured together by a plastic or metal fastener 14 at one point. The outer band has plastic parts on the side facing the back of the hand and the side facing the palm of the hand.

Description of How the Invention Operates/Functions: The top (outer) band may be slightly larger in diameter than the bottom (inner) band and the larger band may lie over the smaller band. The two bands 16, 18 may be secured together by a plastic or metal fastener at one point. The outer band may include a nerve point tool 8 which may be plastic parts on the side facing the back of the hand and the side facing the palm of the hand. When the two bands 16, 18 are worn around the wrist while overlapping one another, the band is considered to be in the "unarmed position". When desired, the bands 16, 18 can be positioned in the "armed position" by simply pulling the top band over the thumb and letting it rest between the thumb and index finger. In the "armed position" the plastic parts are resting in the palm area of the hand and across the back part of the hand. These plastic parts are now positioned to strike, press, or rub against any exposed portion of the aggressor's body. These plastic parts can be directly applied to pressure points as well or they can be used to assist in escorting an individual through pain compliance and/or widely known pressure point methods.

Features of Invention: the protection device 100 of the present invention may be readily available at all times since it is worn around the wrist in an "unarmed state". When needed, the protection device 100 may be simply and quickly be moved to an "armed state" by pulling the top band over the thumb and allowing it to rest between the thumb and index finger. This allows it to be used with either an open or closed hand, the protection device 100 may be difficult to drop, and the protection device 100 may not be taken from the user without great effort. In addition, because the plastic parts are near the palm of the hand, great force and pressure and can be applied to the aggressor when pressing, rubbing, or striking an exposed part of the attacker's body. It is non-lethal in nature, simple to use, and is suitable for almost everyone. The nerve point tool 8 may include plastic parts which may cause an immediate response/reaction from the aggressor when applied to his or her pressure points. Escorting an individual can be accomplished by simply squeezing the palm of the hand that is wearing the band around the aggressor's wrist or forearm.

Two strong elastic bands 16, 18 may made from silicone or another suitable material. The top (outer) band may be slightly larger than the bottom (inner) band. The two bands 16, 18 may be secured together at one point I a fastener 14 (in close proximity with the wrist bone when worn) which may be a clasp or rivet or other suitable device. On the front and back side of the top band there are hard plastic parts with abrasive/sharp edges that are securely fastened to the band.

ALTERNATIVE EMBODIMENTS

Alternative Embodiments of Invention: The protective device 100 of the present invention may be made of different materials for aesthetic purposes. The plastic parts could be made of metal to increase effectiveness. Custom logos or names could be placed on the exterior of the bands for police departments, corporations, groups, The protection device 100 may be worn as a discrete wristband which may be transformed into an highly effective protection device in the blink of an eye. If the user is threatened, the user may extend the band 18 over the thumb to be transformed into an armed position as the outer band is positioned across the palm of the hand which may be embedded with the nerve point tool 8 which may act as laden stingers. When the nerve point tool 8 comes in contact with the attackers exposed skin they may cause an intermediate and involuntary pulling way response. This may create the sensation of being stung multiple times.

The present invention exploits the involuntary actions of the attacker central nervous system which may be called the reflex arcs. To avoid injury in threatening situations, the reflex arcs provide the means for immediate and rapid withdrawal from dangerous or painful stimuli without first obtaining permission from the brain. Examples of reflex arcs include touching hot surfaces, stepping on a sharp object, or being stung by an insect.

The present invention takes advantage of the attacker's innate safety mechanism by causing the attacker to involuntary pull away.

The present invention may be worn around the wrist as an inconspicuous bracelet. The present invention may be positioned into an armed state in less than one second.

The sharp points of the nerve point tool 8 on the band 16, 18 may physically mark the aggressor, making it easier to identify him or her to police The aggressor's DNA/skin will be left on the points of the nerve point tool 8, assisting with filing charges/prosecution.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. A protective device worn around the wrist of a user, comprising:

a wristband positioned around the wrist of the user;

a hand band connected to the wristband via at least one attachment point, the hand band including at least one nerve point tool having sharp points and edges extending outward from the hand band that contact with and stimulate a nerve point of an assailant in an armed state, wherein the hand band is positioned around the wrist of the user aligned with the wristband when in an unarmed state and positioned between the thumb and the index finger of the user in the armed state, wherein the wristband and the hand band are formed of a flexible and expandable material.

2. A protective device worn around the wrist of the user as in claim 1, wherein the wristband includes a nerve point tool having at least one sharp point extending outward from the wristband to stimulate a nerve point of an assailant.

3. A protective device worn around the wrist of the user as in claim 1, wherein the wristband includes an interior band portion having a nerve point tool including at least one sharp point extending outward from the interior band portion to stimulate a nerve point of an assailant.

4. A protective device worn around the wrist of the user as in claim 1, wherein the hand band includes a palm band portion having a nerve point tool including at least one sharp point extending outward from the palm band portion to stimulate a nerve point of an assailant.

5. A protective device worn around the wrist of the user as in claim 1, wherein the hand band includes a back hand band portion having a nerve point tool including at least one sharp point extending outward from the back hand band portion to stimulate a nerve point of an assailant.

* * * * *